US006419165B1

(12) United States Patent
Schroeder

(10) Patent No.: US 6,419,165 B1
(45) Date of Patent: Jul. 16, 2002

(54) BEAD/PAINT SPRAY GUN

(75) Inventor: James C. Schroeder, Ramsey, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 218 days.

(21) Appl. No.: 09/138,445

(22) Filed: Aug. 21, 1998

Related U.S. Application Data

(60) Provisional application No. 60/056,222, filed on Aug. 21, 1997.

(51) Int. Cl.[7] ..... E01C 7/32
(52) U.S. Cl. ..... 239/290; 239/418
(58) Field of Search ..... 239/290, 418

(56) References Cited

U.S. PATENT DOCUMENTS

| | | | | |
|---|---|---|---|---|
| 2,756,103 A | | 7/1956 | Creswell | 299/86 |
| 2,821,890 A | | 2/1958 | Wilson | 94/44 |
| 3,033,472 A | | 5/1962 | Shelton V | 239/408 |
| 3,057,273 A | | 10/1962 | Wilson | 94/44 |
| 3,125,298 A | * | 3/1964 | Iwata | 239/418 |
| 3,286,605 A | | 11/1966 | Wilson et al. | 94/44 |
| 3,788,555 A | | 1/1974 | Harrison et al. | 239/336 |
| 3,844,485 A | | 10/1974 | Waggoner | 239/420 |
| 4,856,931 A | | 8/1989 | Bollag | 404/75 |
| 5,275,504 A | | 1/1994 | Nonemaker | 404/72 |
| 5,351,890 A | | 10/1994 | Clements | 239/143 |

* cited by examiner

*Primary Examiner*—Steven O. Douglas
(74) *Attorney, Agent, or Firm*—Douglas B. Farrow

(57) ABSTRACT

A typical airless spray gun is provided with an extension pole having a reversible airless tip assembly at the end thereof. A parallel line holding a pressured source of beads is attached to the pole and has a terminating deflector which is located inside one of the loops of the tip guard of the airless reversible tip assembly. The beads are thus ejected into the spray pattern at approximately the locus of atomization of the sprayed paint thereby resulting in enhanced atomization.

2 Claims, 2 Drawing Sheets

BEAD/PAINT SPRAY GUN

RELATED APPLICATIONS

This application is a continuation-in-part of U.S. application Ser. No. 60/056,222, filed Aug. 21, 1997.

BACKGROUND OF THE INVENTION

Various types of line stripers have been used for a number of years to apply stripes to parking lots, roadways and the like. Somewhat more recently, reflective beads have been utilized to enhance the reflectivity of the stripes. Typically to do so, the paint is sprayed onto the road and a layer of beads is sprayed down onto the wet paint or generally into the spray substantially downstream from the gun. Although generally effective, a somewhat less than homogenous mixture of paint and beads results.

SUMMARY OF THE INVENTION

It is therefore an object of this invention to provide a hand bead/paint spray gun which yields enhanced mixing of beads and paint in a homogenous fashion which is easily and inexpensively manufactured.

A typical airless spray gun is provided with an extension pole having a reversible airless tip assembly at the end thereof. A parallel line holding a pressured source of beads is attached to the pole and has a terminating deflector which is located inside one of the loops of the tip guard of the airless reversible tip assembly. The beads are thus ejected into the spray pattern at approximately the locus of atomization of the sprayed paint thereby resulting in enhanced atomization.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
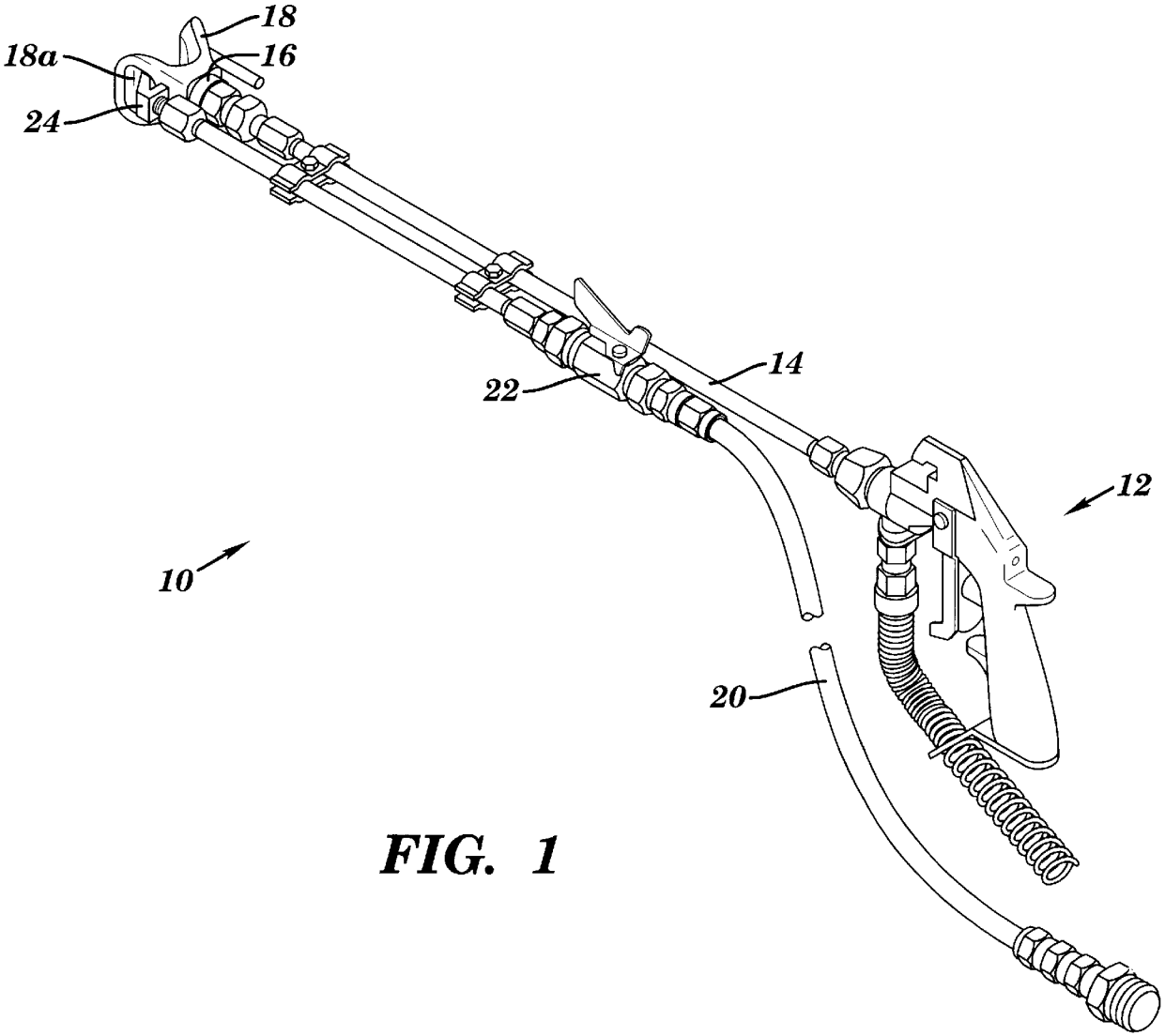
FIG. 1 shows the device of the instant invention.

FIG. 1 shows the device of the instant invention generally designate 10 of which is comprised of a conventional airless spray gun 12 having an extension pole 14 affixed thereto which terminates in a conventional reversible airless tip assembly 16 having a tip guard 18 thereon and openings 18*a* therein.

Connected to a source of pressurized beads is a hose 20 having a valve 22 thereon and terminating in a deflector 24 which ejects the beads into the pattern of the spray gun at approximately the locus of atomization.

Figure 2:
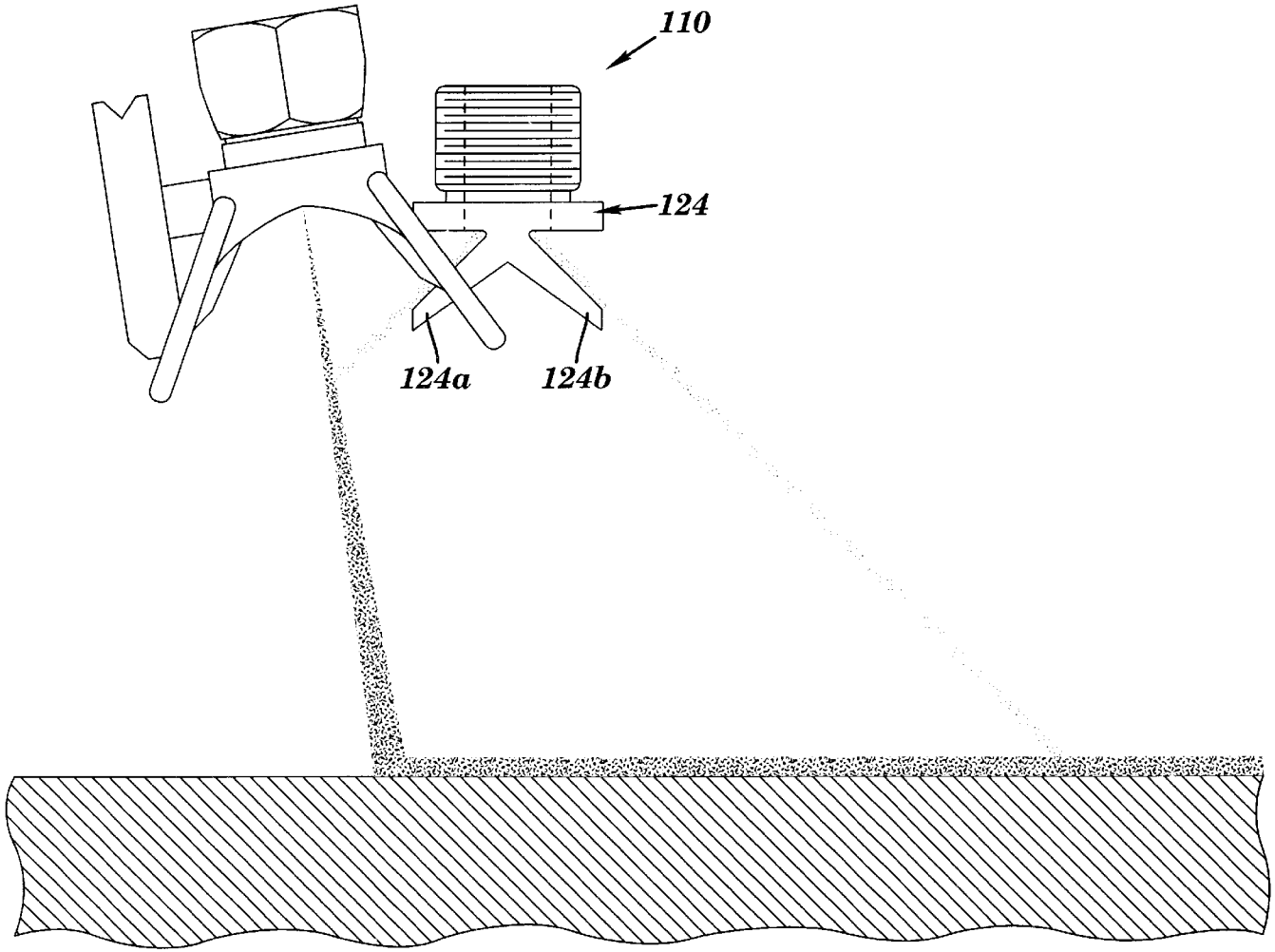
FIG. 2 shows an alternate embodiment of the instant invention having a double bead pattern.

FIG. 2 shows an alternate embodiment 110 of the instant invention having a deflector 124 with dual outlets 124*a* and 124*b*. First outlet 124*a* ejects a portion of the beads into the locus of atomization of the sprayed pattern while the second outlet 124*b* ejects a stream of beads onto the already painted surface to add a final additional measure of reflectivity and to make sure that some of the beads stay on top of the stripe.

It is contemplated that various changes and modifications may be made to the gun without departing from the spirit and scope of the invention as defined by the following claims.

What is claimed is:

1. A gun for spraying striping paint and reflective beads onto a surface, said gun comprising:

an airless tip assembly which atomizes paint passed therethrough at a locus of atomization shortly in front of said tip assembly; and means for injecting reflective beads approximately into said locus of atomization, said injecting means being attached to a source of reflective beads.

2. The striping gun of claim 1 further comprising means for spraying said reflective beads directly onto said surface.

* * * * *